US009447930B1

(12) United States Patent
Simon

(10) Patent No.: US 9,447,930 B1
(45) Date of Patent: Sep. 20, 2016

(54) MULTI FUNCTION LED LIGHT BULB AND LUMENAIRS WITH INTERCHANGEABLE OPTICAL COMPONENTS

(71) Applicant: Jerome H. Simon, Watertown, MS (US)

(72) Inventor: Jerome H. Simon, Watertown, MS (US)

( * ) Notice: Subject to any disclaimer, the term of this patent is extended or adjusted under 35 U.S.C. 154(b) by 0 days.

(21) Appl. No.: 14/671,546

(22) Filed: Mar. 27, 2015

Related U.S. Application Data

(60) Provisional application No. 61/967,866, filed on Mar. 28, 2014.

(51) Int. Cl.

| | |
|---|---|
| ***F21K 99/00*** | (2016.01) |
| ***F21V 7/04*** | (2006.01) |
| *F21Y 101/02* | (2006.01) |
| *F21Y 105/00* | (2016.01) |
| *F21Y 103/02* | (2006.01) |

(52) U.S. Cl.
CPC . *F21K 9/50* (2013.01); *F21K 9/52* (2013.01); *F21V 7/04* (2013.01); *F21Y 2101/02* (2013.01); *F21Y 2103/022* (2013.01); *F21Y 2105/003* (2013.01)

(58) Field of Classification Search
CPC ..... F21K 9/50; F21K 9/52; F21V 7/04
See application file for complete search history.

(56) References Cited

U.S. PATENT DOCUMENTS 8,899,783 B1 * 12/2014 Simon ..... F21K 9/50 362/235
2015/0009679 A1 * 1/2015 Seki ..... G02B 7/022 362/307

* cited by examiner

*Primary Examiner* — Mary Ellen Bowman
(74) *Attorney, Agent, or Firm* — Burns & Levinson LLP; David W. Gomes; Jerry Cohen

(57) ABSTRACT

Multi function LED light bulbs and luminairs includes interchangeable optical components.

20 Claims, 12 Drawing Sheets

MULTI FUNCTION LED LIGHT BULB AND LUMENAIRS WITH INTERCHANGEABLE OPTICAL COMPONENTS

CROSS REFERENCE TO RELATED APPLICATIONS

This application claims priority from U.S. Provisional Patent Application Ser. No. 61/967,866, filed Mar. 28, 2014 and incorporated herein by reference in its entirety.

SUMMARY OF THE INVENTION

One embodiment of the present invention provides multifunction LED light bulb comprising: a) a first optical structure surrounding a central optical axis and containing at least one LED at least partially surrounded by a concentrating surface, the first optical structure performing a first lighting function of projecting a forward concentrated beam surrounding and in the direction of a central optical axis of the bulb; b) a second lighting structure containing at least one LED at least partially surrounded by a concentrating surface and a radially reflecting surface, the second lighting structure performing a second lighting function by projecting a concentrated radial beam away from the optical axis; wherein the LEDs and optical surfaces of the optical structure performing the first lighting function, and the LEDs and optical surfaces of the optical structure performing the second lighting function so disposed as to not obstruct the projected light emanating from the LEDs or their associated optics.

The optical structures and their associated optical surfaces that perform both lighting functions may be incorporated into a single unified molded element. The optical structure performing the second lighting function may comprise internally reflecting surfaces that function as a light guide for the radially projected beam. The concentrating surface(s) of the first optical structure may be parabolic. The concentrating surface(s) of the first optical structure may be ellipsoidal.

The first lighting function of the first optical structure and the radially reflecting surface of the second optical structure are performed by a single optic having and internal surface with a first portion shaped and located to receive light from the first LED at a high angle of incidence and refract substantial light along the optical axis through the internal surface, and a second portion of the internal surface being shaped and located to receive light from the second LED at a low angle of incidence to reflect that light radially. The unified single surface may be parabolic. The unified single surface may be elipsoidal. The radially reflecting surface of second optical structure may be internally reflective.

The first optical structure may comprise a single LED located on the central axis and is at least partially surrounded by a concentrating surface, and wherein the second optical structure comprises at least two LEDs that extend outward from and are disposed around the optical axis, each at least partially surrounded by a concentrating optic, and a reflective ring that reflects light from the LED and its associated concentrating optic as a radial beam away from the central axis. The first and second optical structures may be fabricated from optical materials such as polymer plastics that may include acrylic, polycarbonate, silicone, and other suitable materials such as glass and reflective metals.

Another embodiment of the present invention provides a composite multifunction light bulb system comprising: a) a first component being a reflector type light bulb having a central optical axis, and a optical structure containing at least one LED at least partially surrounded by a concentrating reflector projecting a concentrated linear beam surrounding and in the direction of the central optical axis; b) a second component being an adaptor containing an optical structure and a mechanism for attachment to the first component; c) the optical structure of the second component having an optical element(s) that redirect at least a portion of the concentrated linear beam projected by the optical structure of the first component in a direction away from the central optical axis.

The optical structure of the second component contains a reflective surface that redirects and projects at least a portion of the linear concentrated beam projected by the optical structure of the first component as a beam radiating outward from the optical axis. The optical structure of the second component may contain at least one light guide(s) that receive and guides at least a portion of the linear concentrated beams projected by the optical structure of the first component away from the first component.

Yet another embodiment of the present invention provides an optical structure for radially projecting a beam comprising: a substantially disk shaped optical element at least partially surrounding one LED and sharing the optical axis with one LED that is located on the optical axis at the entry surface of a disk shaped optical element, the disk shaped optical element having a radially disposed internally reflecting toroidal concentrating optic, and an exit surface circumscribing the disk through which radially reflected light (emanating from the LED) can pass, and at least one step in the surface of the disk that surrounds the optical axis, the face of the step forming an exit surface through which radially reflected light can pass. The step(s) in the surface remove(s) and reduce(s) mass from the disk shaped optical element.

The face of at least one step may be substantially perpendicular to the surface of the disk to which it is connected. The face of the one or more steps may be substantially at an angle to a surface of the disk to which it is connected.

BRIEF DESCRIPTION OF THE DRAWINGS

FIGS. 8A and 8B are respectively a side view sectional diagram and a plan view of a lighting device constructed in accordance with an embodiment of the present invention.

FIG. 12 is a plan view of a pair of concentric rings having numerous LED bulbs. FIG. 12A is a side view of the same rings and a male socket. FIG. 12B is a side sectional view similar to FIG. 12A but with additional light guide features. FIG. 12C is a side sectional view of a similar fixture with downward reflecting elements surrounding the LED rings.

Multifunction composite light bulb systems provide manufactures the opportunity to utilize an already existing LED light bulb and or components therein to provide end users a variety of lighting products and lighting functions by swapping out adaptor with the existing Led light bulbs. Examples of multifunction composite light bulb systems are illustrated in FIGS. 4 through 8B and 13.

One specific example of this is a candelabra decorative product derived from a single Led light bulb in combination with an adaptor containing light guides and refractors that simulate candle flames.

Figure 1:
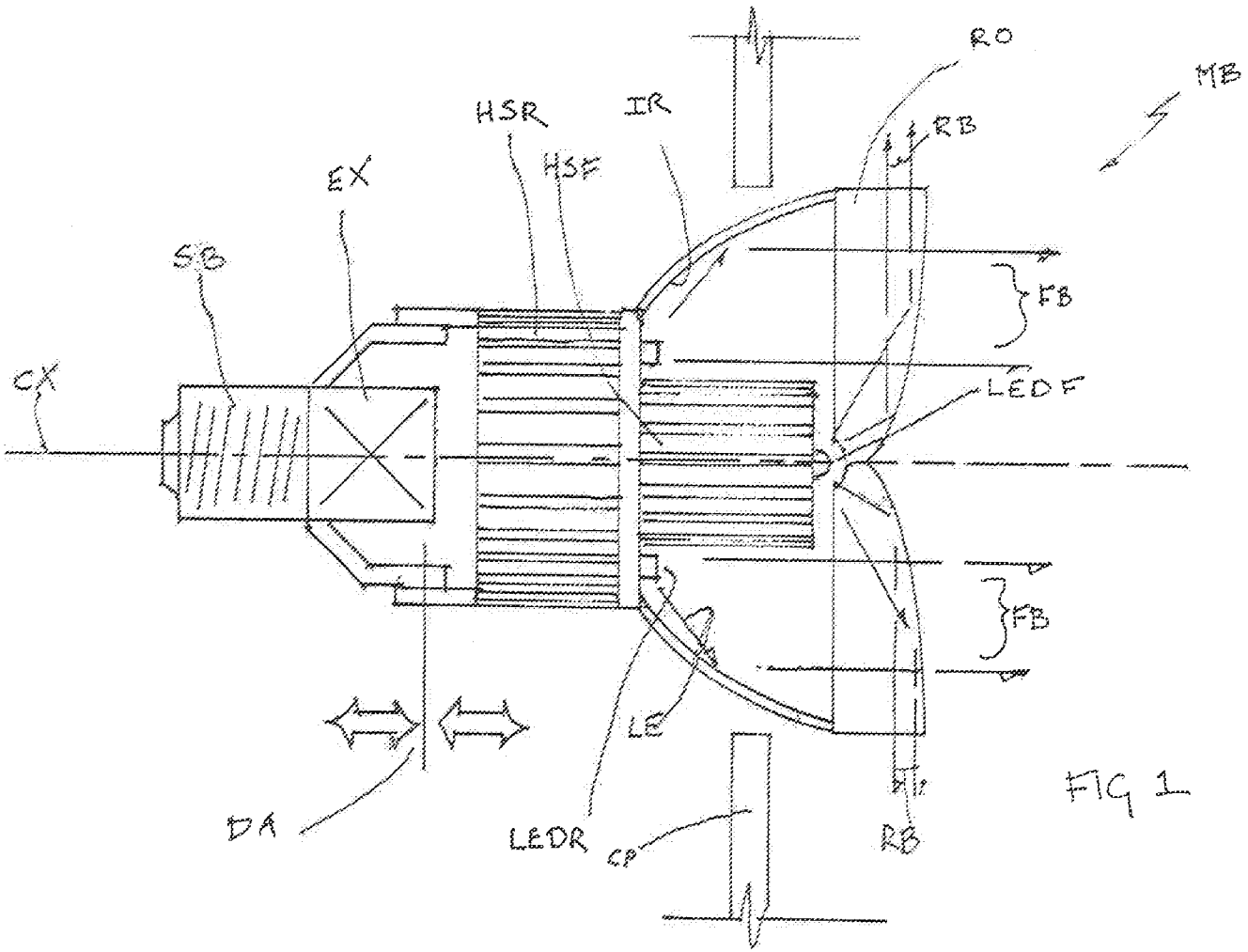
FIG. 1 is a combined side view cross sectional diagram of a multifunction LED light bulb constructed in accordance with one embodiment of the present invention.

FIG. 1 is a combined side view cross-sectional diagram of a multifunction LED light bulb MB. Multifunction LED light bulb MB is shown to have the form factor of a reflector lamp that can be used in recessed ceiling fixtures or in other luminaires commonly known for commercial and residential illumination. Multifunction light bulb MB also contains a socket base SB such as a med, miniature, or mogul screw on other standard light bulb base, for multifunction light bulb MB can be used as a retrofit project.

The multifunction LED light bulb MB contains two separate and distinct optical structures that share a common central bulb axis CX.

The first of the two distinct optical structures contains an LED ring of at least two LEDs LEDR is mounted to a heat sink HSR. The first optical structure further contains a reflecting surface IR which at least partially surrounds and receives at least a portion of the light emanating from the LED and reflects it in the direction of, and surrounds, the central axis CX as beam FB.

Forward beam FB projected by the first optical structure passes thru the internally reflective optic RO.

The second of the two distinct optical structures contains at least one LED LEDF mounted to a heat sink HSF (if a heat sink is required). The second optical structure further contains an internally reflective radially projecting optic RO which receives and reflects light emanating from the LED as a radially projected beam RG away from the central bulb axis CB. Electronic package EX located within the body of the bulb provides the proper operating current and voltage to the LEDs of the optical structures.

Multifunction LED light bulb MB can contain a telescoping tube (mechanism) to alter the length of light bulb MB as indicated by arrows DA for a variety of installation conditions. Dotted line FR indicates a housing that may be incorporated to create the shape of a standard reflector lamp.

Figure 2:
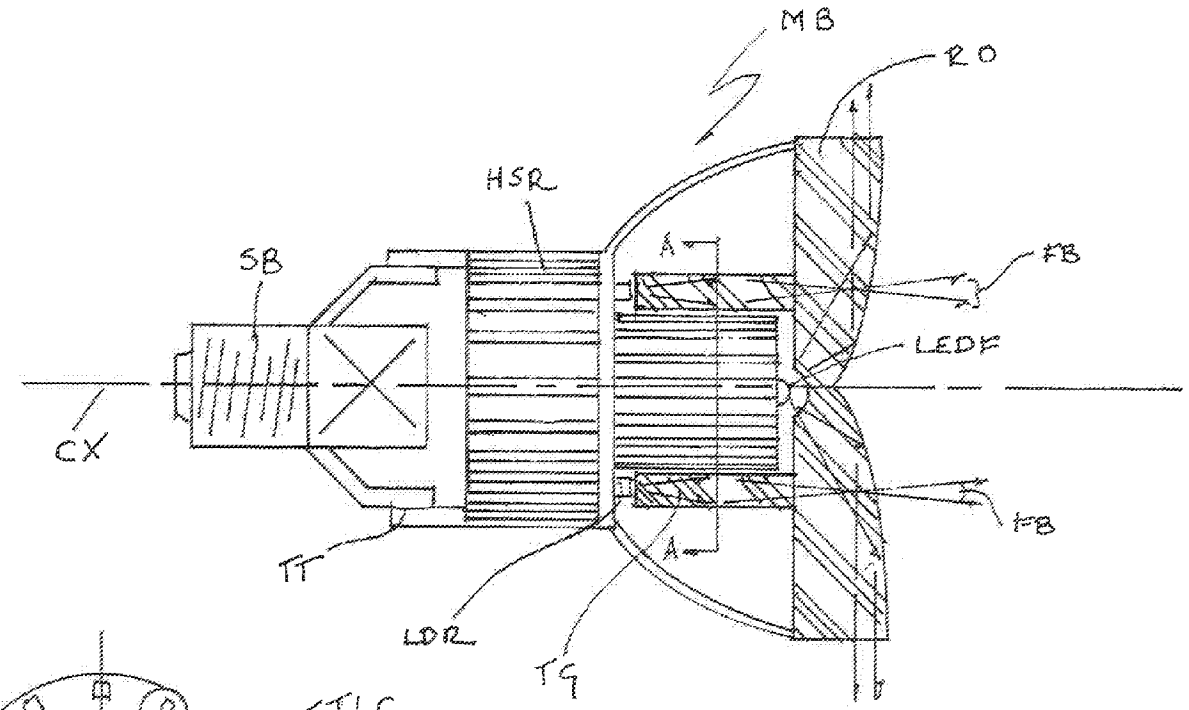
FIG. 2 is another combined sectional side view of a multifunction LED light bulb constructed in accordance with another embodiment of the present invention.
Figure 2A:
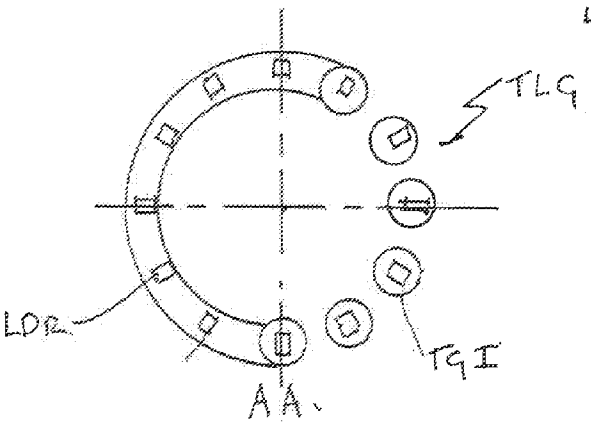

FIGS. 2 and 2A are combined section views/side views of a multifunction LED light bulb similar to that shown in FIG. 1. Multifunction LED light bulb MB differs from the multifunction LED light bulb MB shown in FIG. 1 in that the first of the two optical structures that contain a ring of LEDs LDR contains a tubular light guide TLG rather than a reflector to gather and project light emanating from the forward beam FB.

FIG. 2A is a section AA taken through the first optical structure showing that tubular light guide TLG can (among possible configurations) have a continuous solid cross section or comprise a geometrically disposed configuration of individual light guides TGI, at least one of which can be dedicated to guide light from an individual LED. Forward beam FB passes thru radially refracting optic RO.

Figure 3:
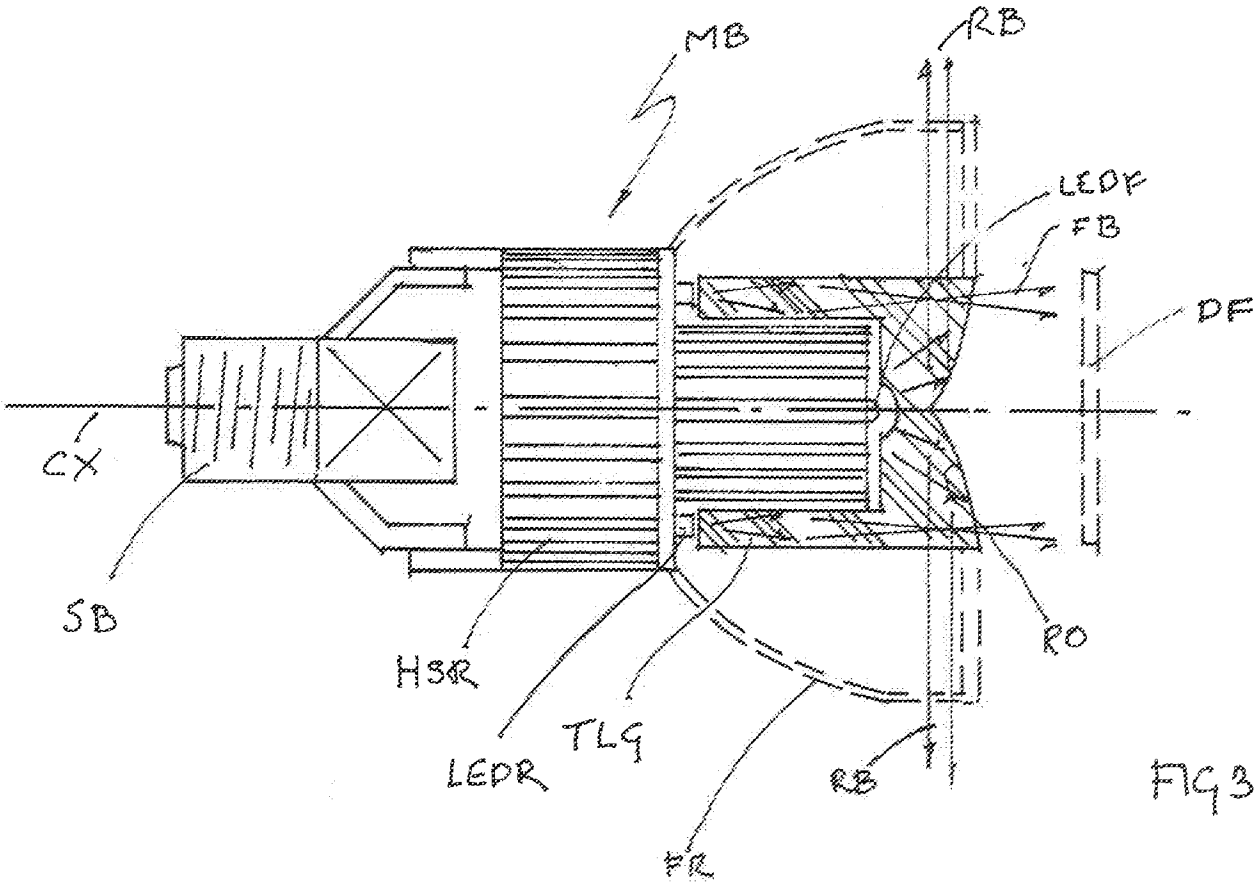
FIG. 3 is a combined side sectional view of a multifunction LED light bulb constructed in accordance with still another embodiment of the present invention.

FIG. 3 is a combined side/section view of a multifunction LED light bulb MB similar to that shown in FIG. 2, differing in that the tubular light guide TLG and the radially reflecting optic RO are fabricated as a unified optical element and functions to project a forward beam FB and a radial beam RB, as described in FIGS. 1 and 2.

Figure 4:
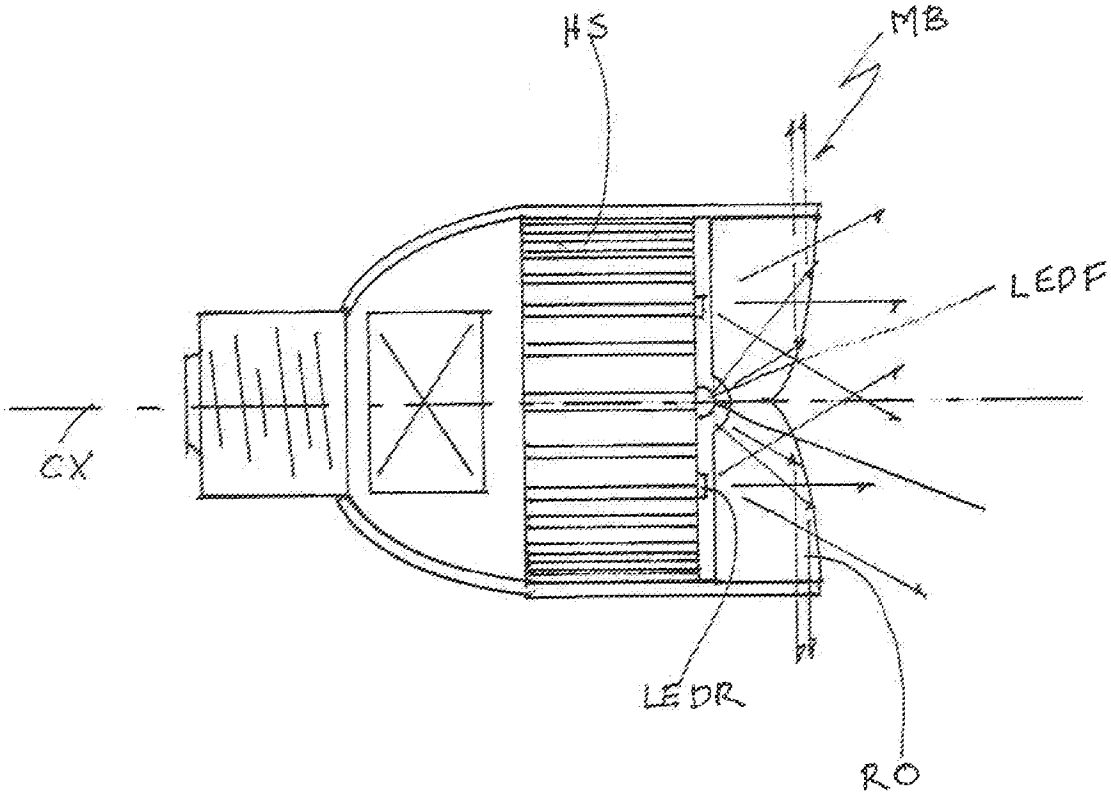
FIG. 4 is a combined side sectional view of a multifunction LED light bulb constructed in accordance with an embodiment of the present invention.

FIG. 4 is a combined side/section view of a multifunction LED light bulb MB similar in function to those illustrated in FIGS. 1 thru 3, differing in that the forward LED FB is on substantially the same plane and shares the same heat sink HS as the ring of LEDs LEDR. Also, the internally radially reflecting optic RO is described to be removable to change or replace the LEDs therein, or be adapted to existing LED bulbs.

Figure 5B:
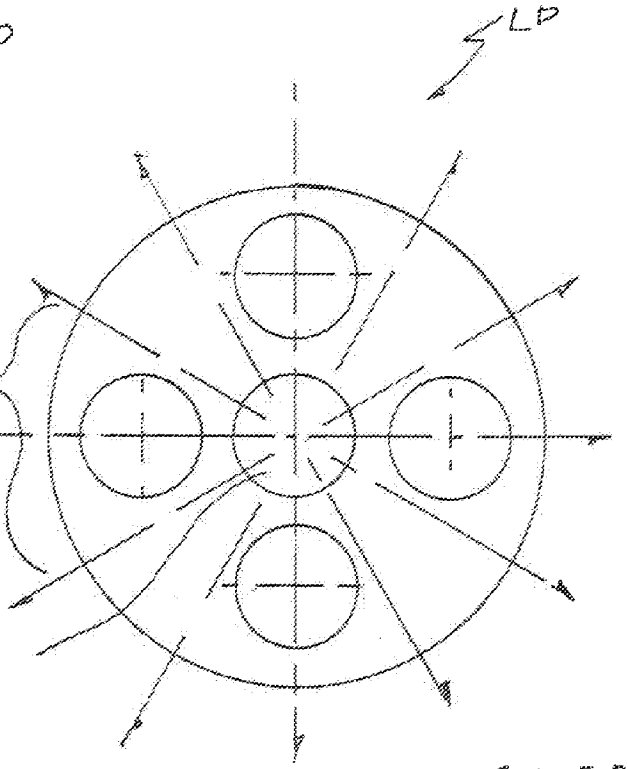
FIGS. 5A and 5B are respectively a side sectional you diagram and a plan view of an LED lighting device constructed in accordance with an embodiment of the present invention.
Figure 5A:
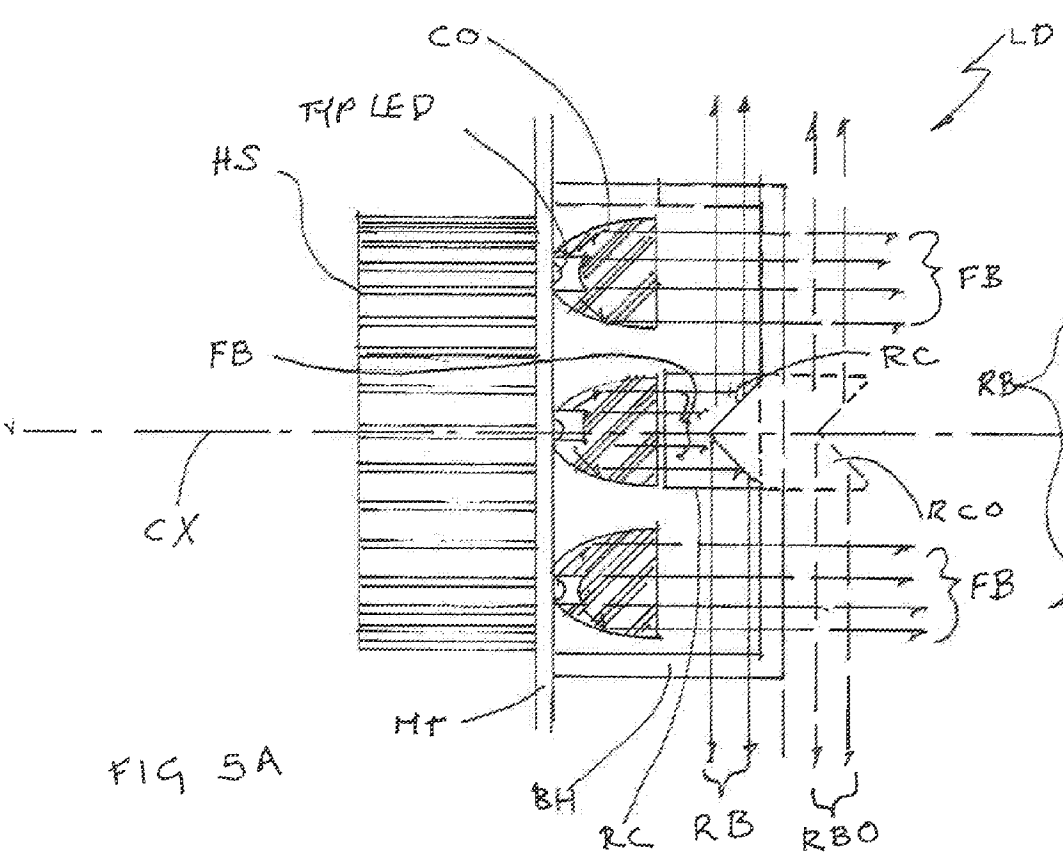

FIGS. 5A and 5B are respectively a side/section view diagram and a plan view of an LED lighting device that can be used as a luminaire, LED light bulb or a combination of both, any of each having at least a radially projecting function and forward throw function. The lighting device LD contains a $1^{st}$ and $2^{nd}$ optical structure(s), each sharing a common central axis CX.

The 1st optical structure is a geometric arrangement of at least two LEDs at least partially surrounded by a light condensing optic CO that collects and projects light from its associated LED as a forward throw beam FB in the direction of and along side of the central axis CA of the lighting device LD.

The $2^{nd}$ optical device is an internally reflective cone RC (which in this embodiment is disposed on the central axis CA, of the device LD) which receives and directs a forward beam FB emanating from a light condensing optic LO of the $1^{st}$ optical device as a radial beam RB away from the central axis CX.

Through the use of a mechanical device (not detailed), internally reflective cone RC can be positioned at different distances from and along the central axis CA its associated condensing optic CO (indicated by dotted cone shape RCO) thus increasing the distance of radial beam RB (Indicated by dotted arrows RBO), from its associated condensing optic CO. Lighting device LD can be at leas semi recessed in an architectural panel MT. The optical structures described herein can be contained within an enclosure BH fabricated from material(s) that allow forward beam(s) FB and radial beam RB to pass through.

Figures 6A, 6B:
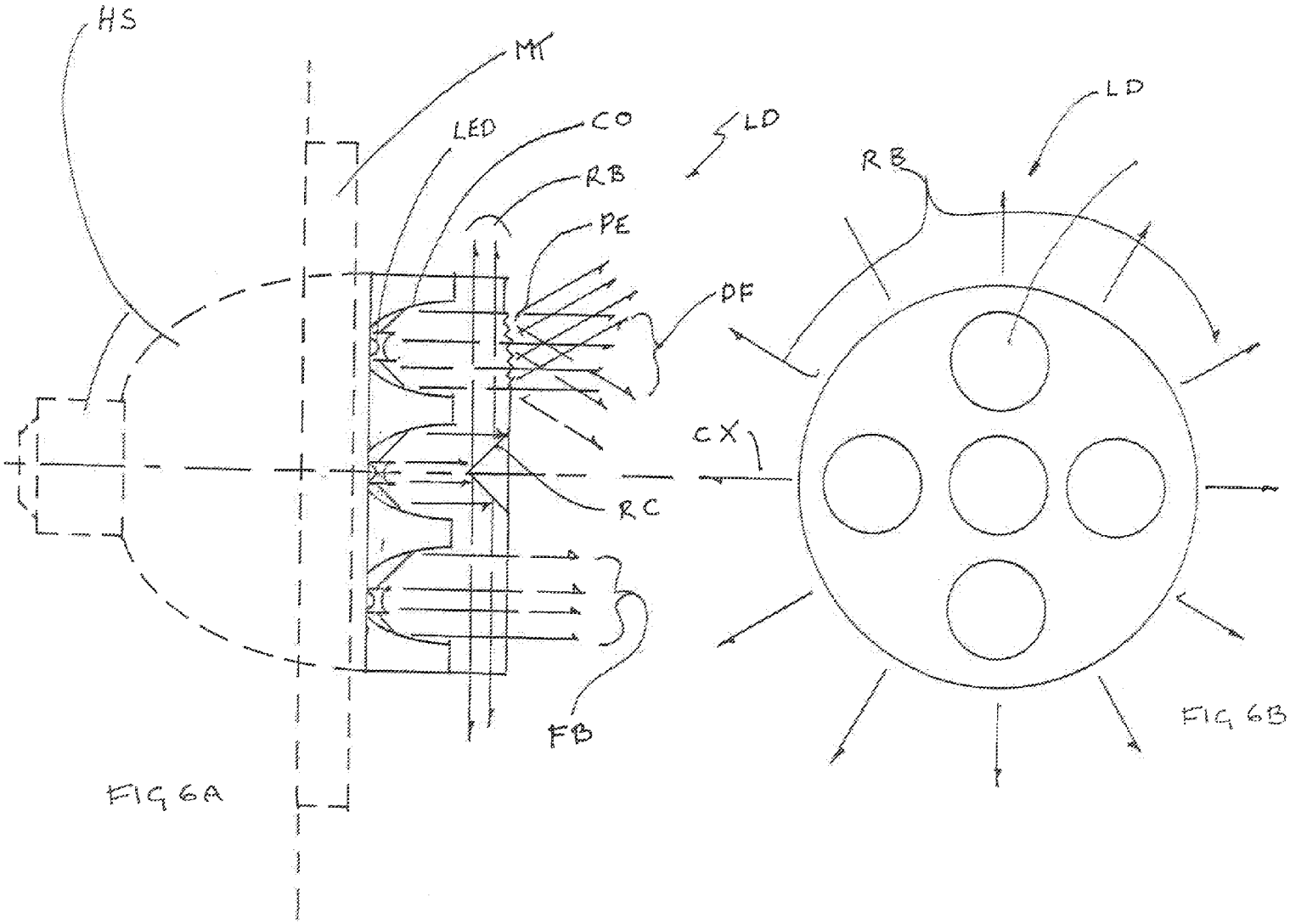
FIGS. 6A and 6B are sectional and plan views, respectively, of a section and of an illuminating device constructed in accordance with an embodiment of the present invention.

FIGS. 6A and 6B are section and plan views respectively of a section and a plan view of an illuminating device LD that can be configured as an LED light bulb or surface mounted luminaire which has a radial projection function and a forward throw function. The optical system illustrated in FIG. 6 differs from the optical system shown in FIG. 5A in that the collecting optic CO of the $1^{st}$ optical structure in that the collecting optic CO of the $1^{st}$ optical structure is combined with the internally reflecting cone of the $2^{nd}$ optical structure into a unified optical structure. At least of the forward surface of the combined 1st and $2^{nd}$ optical structures can contain primatic elements PE that can create changes (such as dispersion DF) in the light exiting the optical structure.

Figure 7:
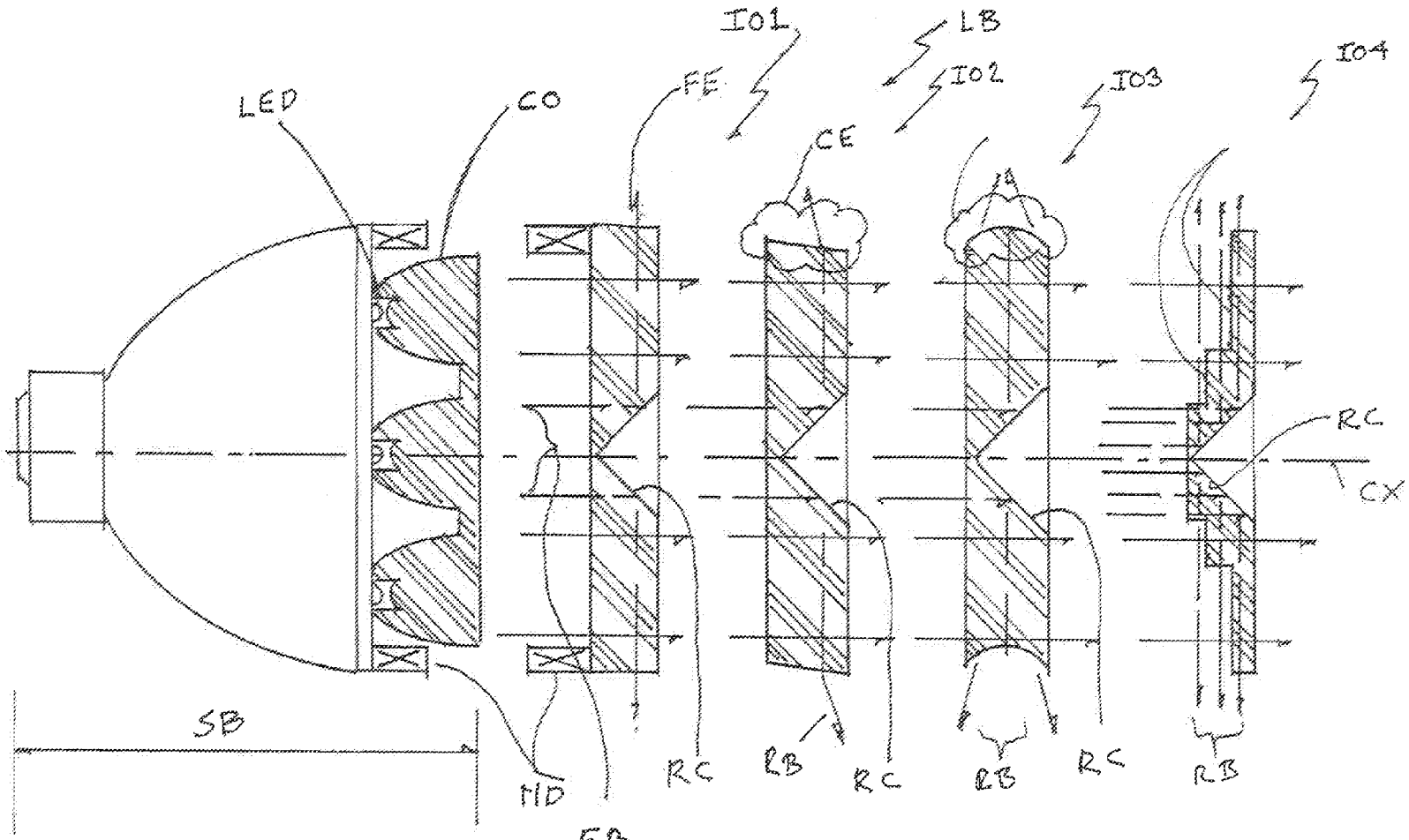
FIG. 7 is a cross-sectional side view diagram of a multifunctional LED lightbulb constructed in accordance with an embodiment of the present invention.

FIG. 7 is a cross-section/side view diagram of a multi-function LED light bulb LB that combines a standard type LED beam projecting bulb SB with an instant invention radial beam projecting optic. Illustrated is a standard off-the-shelf LED light bulb SB using commonly used existing LED technology, namely a geometric arrangement of LEDs (surrounding the central axis CX of the bulb LB), each of the LEDs LED at least partially surrounded by a condensing optic Co that collects and projects light from the LEDs as a forward projecting beam in the direction of and surrounding a central axis central CX.

Further illustrated in FIG. 7 are (in this embodiment) are four different adaptive substantially planar optical structures I01, I02, I03, I04 that, when attached to the above described standard LED light bulb, add a second beam distribution beam to the forward beam, namely a radially projected beam. Each of the adaptive structures contain an internally reflecting cone RC which is axially aligned with one of the condensing optics CO, redirecting the forward FB outward through the edge of the substantially planar optical structure (s) as a radial beam away from the central axis CA. The surrounding edge of each of the four planar optical structures illustrated differ in cross sectional surface shape and optical function as follows; IO1 has a substantially flat cross section surface FE which does not change the direction of the rays of the radially beam passing through the edge of the planar optical structure I01. IO2 has a canted cross sectional surface CE causing an angular cant (in respect to the central axis CA) to the radially projected beam passing through the canted edge of the planar optical structure I02. IO3 has a curved cross sectional surface which can be either convex or concave which accordingly can focus or widen the radial beam as it passes through the edge or the planar optical structure I03. I04 contains a series of at least two substantially concentric surfaces that comprise the edge of the planer optical structure. The section of each concentric surface can have similar sectional shapes and optical functions as those described in I01, I02, I03, or other cross sectional shapes not mentioned in the above. FIG. 7 further illustrates that a mechanical attachment MD such as threaded rings, clips, screws, and other means can be employed to connect and disconnect the planar optical structures from the existing body of the existing bulb.

Figure 8A:
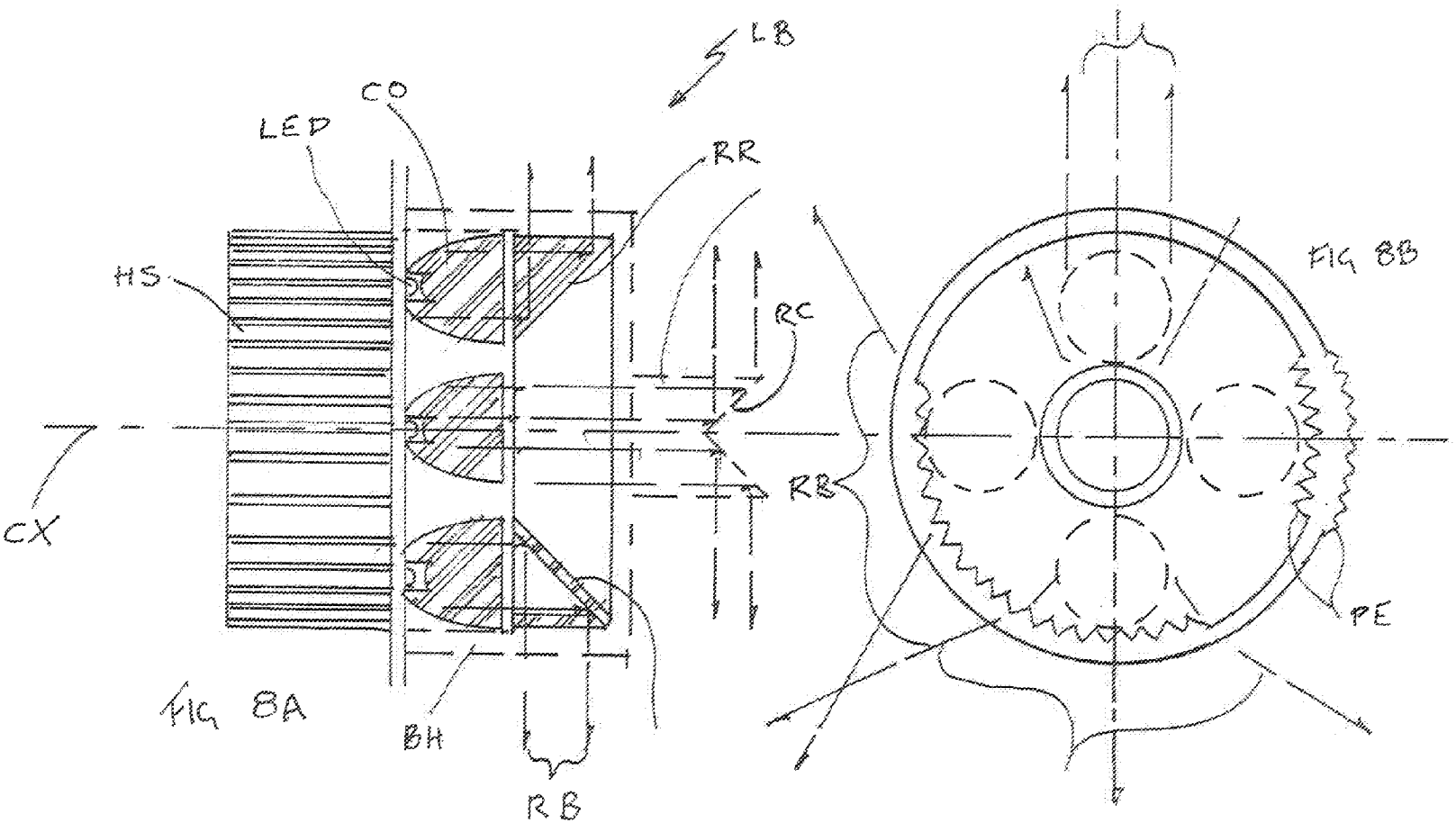
Figure 9:
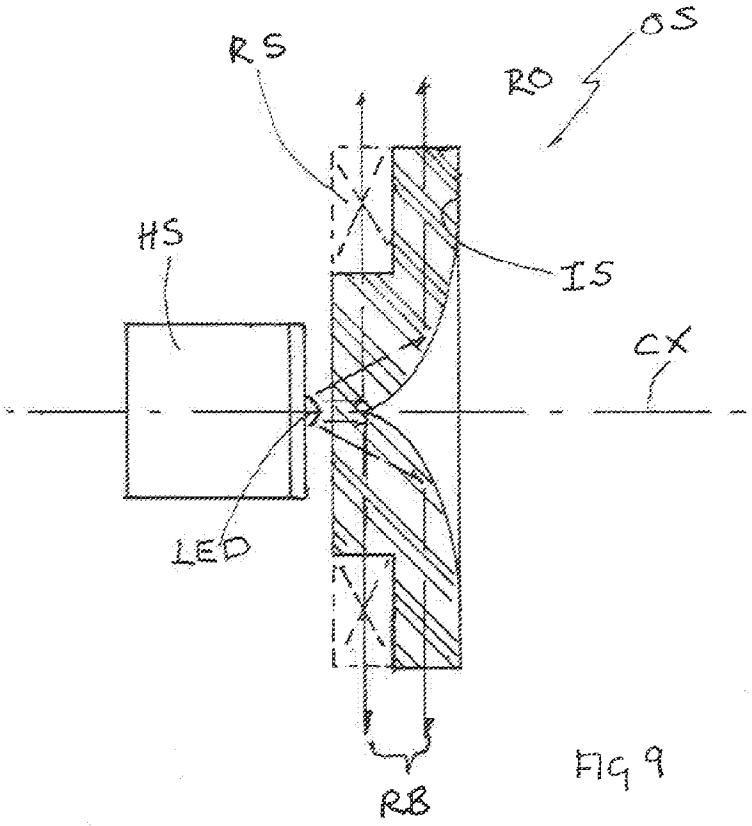
FIG. 9 is a radially projecting internally reflecting lens that can be used in accordance with an embodiment of the present invention.

FIGS. 8A and 8B are respectively a side view/section diagram and a plan view of a lighting device LB that can be used as or with a luminaire or as an LED light bulb. The function of the device—namely to provide both a forward projected beam and a radially projected beam—is similar to that shown in FIGS. 1 thru 7B. Specifically the optical structure of 8A and 8B is similar to the optical structure of 5A and 5B differing in that the latter embodiment contains an internally reflective cone RC to redirect a forward beam FB from a single condensing optic CO, while the optical structure of the current (former) embodiment contains a reflective ring RR that gathers and redirects light from at least two LEDs LED (that surround the central axis CX) radially away from the central axis. The reflective ring (which can be internally reflective) can be flat or curved in cross section, and also contains individual flat surfaces that are aligned with and redirect an individual forward beam FB projected by an individual condensing optic CO as an individual beam away from the central axis CX. The optical structure of the current embodiment can also contain and employ a reflective cone RC to reflect a redirect an individual forward beam FB as a radial beam RB away from the central axis. The optical structure of Lighting device LB can be contained with an enclosure BH, the inner and or outer surfaces of which can contain prismatic elements .PE FIG. 9 is a section view of a an optical structure OS containing similar optical components as those illustrated in FIGS. 1 through 4B, specifically at least one LED LED and a radially projecting internally reflecting lens RO, differing in that in this embodiment internally reflecting lens RO has a radial step RS resulting in reducing the mass of the lens RO without compromising the optical function of the lens RO. Lens RO can be used as a substitute for the radially projecting internally reflecting lenses shown in FIGS. 1 thru 4B, or can be used independently (not in conjunction with a forward projecting optical structure) having the single function of projecting a radially projected beam away from the central axis CX of the optical structure OS.

Figure 10:
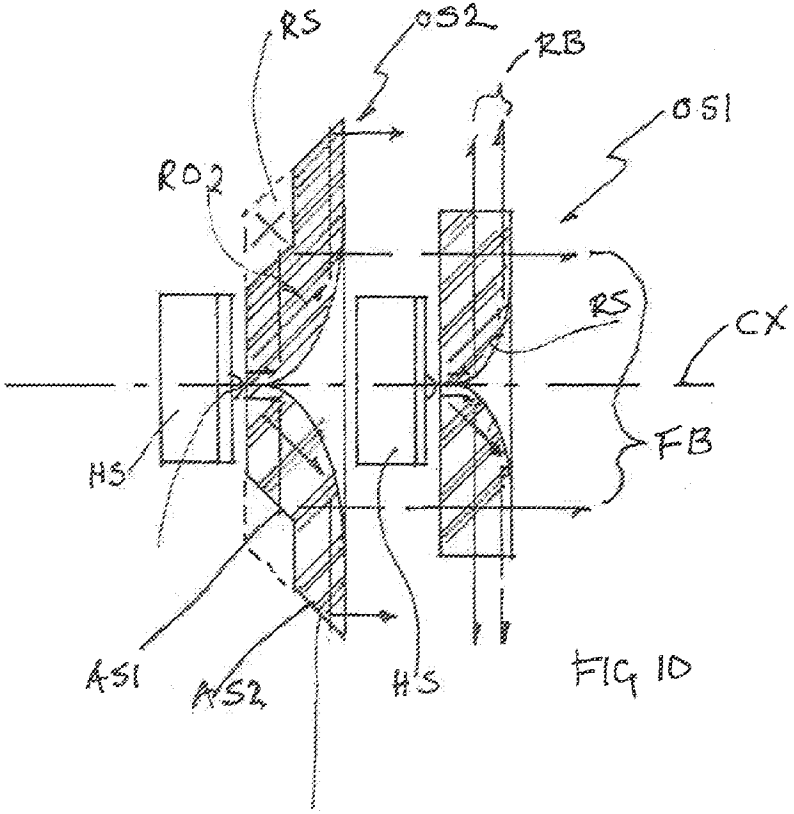
FIG. 10 is a sectional side view of optical elements including angled surfaces for internally reflecting radial beams in an axial direction in accordance with one embodiment of the present invention.

FIG. 10 is a side/section view of two optical structures OS1 and OS2, both sharing and surrounding a common central optical axis CX, each containing similar optical components of the optical structures that are illustrated in FIGS. 1 through 4B and FIG. 9. The combined optical structures OS1 and OS2 can be used in LED luminaires or LED light bulbs similar in function to those illustrated in FIGS. 1 through 4B, the specific function of projecting a forward beam FB by the internally reflective angular surfaces AS1 and AS2 of optical structures OS2, and the specific function of projecting a radial beam RB from internally radially reflecting surface RS of optical structure OS1.

Figure 11:
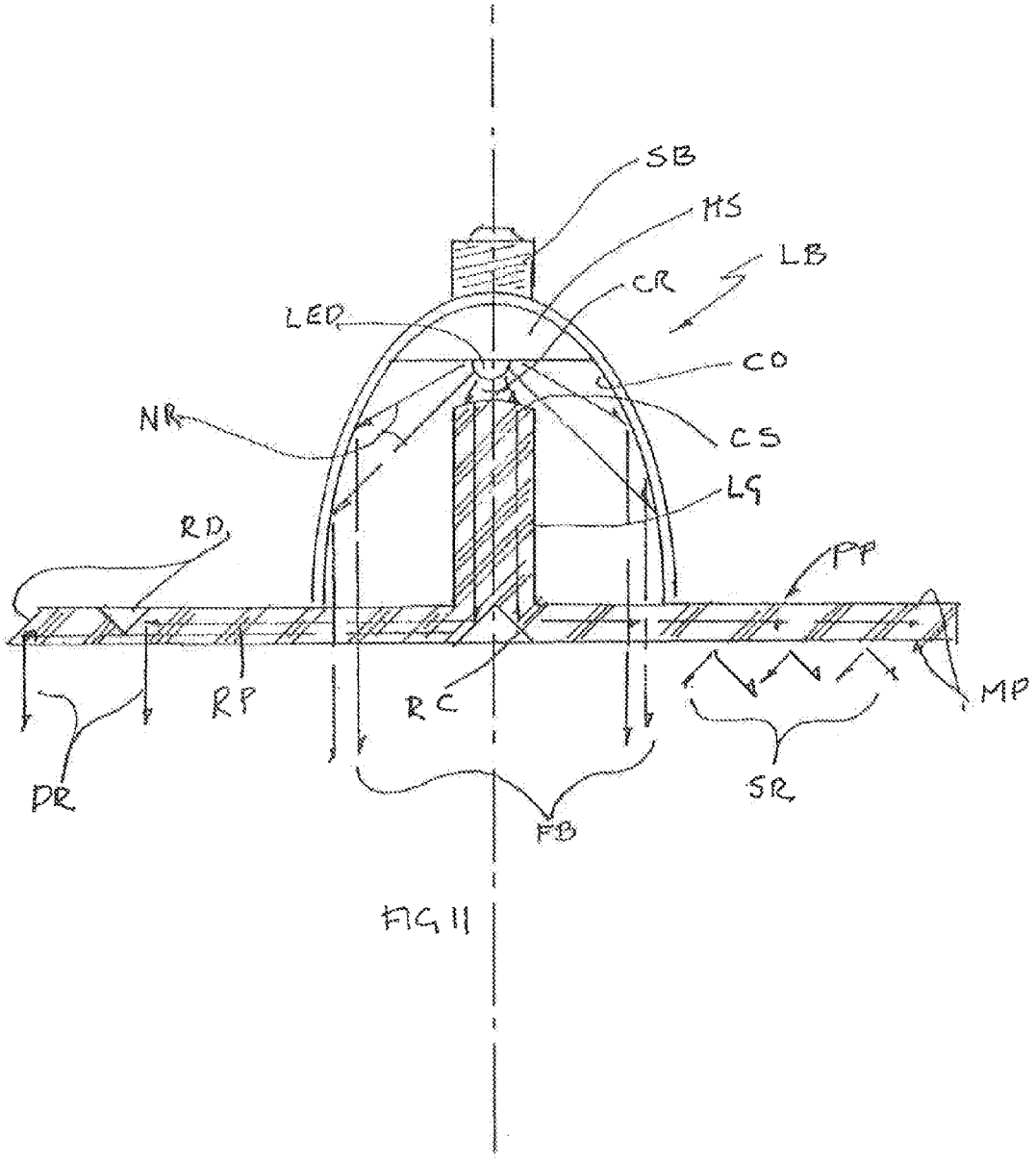
FIG. 11 is a side sectional view of a lamp including a light guide constructed in accordance with an embodiment of the present invention.

FIG. 11 is a side section view diagram of a conventional forward beam throw LED reflector type lighting product such as PAR, R, MR, and BR type bulbs and LED luminaires such as recessed downlights, each of the LED reflector type lighting products having a similar optical structure and related optical components (namely an LED LED and a concentrating reflector CO), and in this embodiment the addition of an adapting optical structure AD that can attach to and alter the illuminating function of the conventional lighting product. The optical structure AD combines a linear light portion LG and a planar (or warped plane) portion PP. The light guide portion LG having a light collecting surface CS that collects and guides a portion of the light-rays CR emanating from the LED LED. The portion of the light rays not collected by collection surface CS, namey rays NR, are reflected and projected through planar light guide portion PP by concentrating reflector surface CO as forward beam FB The planar portion PP receives and light via an internally reflective indented surface RC (which in this embodiment is substantially conical) that redirects the light it receives from the light guide into and through the planar light guide PP. Planar light guide portion PP can comprise internally reflective rings RD which reflect rays RP passing through and away from the planar light guide PP as rays DR. In some embodiments of this instant invention, at least sections of the surfaces of planar light guide PP may contain micro prisms MP which can cause rays RP passing through the planar light guide to exit the surface of the planar light guide portion PP as a predetermined lighting pattern SR. Other embodiments various sections of the linear light guide portion LG and the planar light guide portion PP of the adaptive optical structure AD can be formed as a hollow or solid light guide.

Figures 12, 12A, 12B:
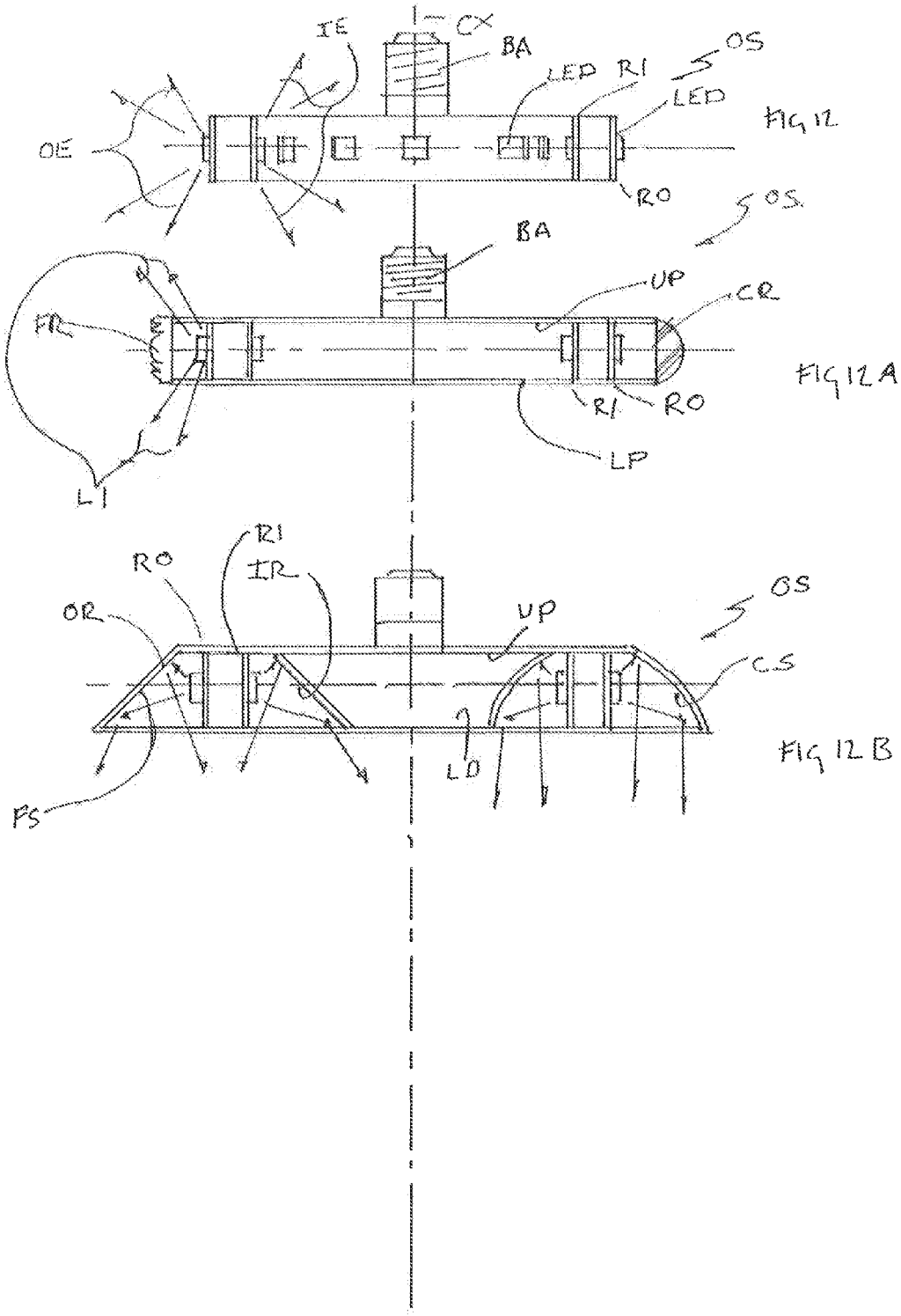
FIGS. 12, 12A, and 12B are various views of a disc like lighting fixture constructed in accordance with one embodiment of the present invention.

FIGS. 12 thru 12B are side section views and a plan view section respectively of configurations of optical structures OS that can used in the formation and fabrication of substantially planar LED light bulbs and luminaires to be employed for various lighting applications. The optical structures of each of the embodiment described in FIGS. 12 thru 12B Can have a male base BA (such as a screw type, pin type, bayonet or other types), and can be at least partially surrounded by a bulb-like housing having an upper portion UP and lower portion LP. Either upper portion UP or lower portion LP can be fabricated from reflective, refractive, or clear material capable of supporting the components of the optical structures. Specifically, FIG. 12 is a side view section of an optical structure containing two rings of LEDS, as an inner LED ring RI and an outer LED ring RO disposed substantially concentric to a common central optical axis CX. Each ring of LEDs contain at least two LEDs mounted to a substrate (which in this embodiment is substantially circular while in other embodiments other geometries are possible), The LEDs LED of the inner ring RI are disposed on the inner surface of the inner ring substrate so the light rays IE emanating from the LEDs LED is directed inwardly toward to the central optical axis CX. The LEDs LED of the outer ring OR are disposed on the outer surface of the substrate so that light rays OE emanating from the LEDs LED is directed outwardly away from the central axis. FIG. 12A Illustrates that the outer ring can be at least partially surrounded by either a Fresnel type focusing lens FR or a focusing lens having a simple convex section CR. The portion of Light LI not collected by either type focusing ring FR or CR can (in this embodiment) emanate unobstructed from the outer ring of LEDs OR. FIG. 12B is a side view section of an optical structure OS similar in form and function as the optical structure Illustrated in FIG. 12. with the addition of an outer reflector ring OR that receives and reflects light emanating from the outer LED ring RO, and an inner reflective ring IR that receives and reflects light emanating from the inner LED ring RI. Both inner reflective ring(s) IR and outer reflective ring(s) OR can be either a flat surface FS or a curved surface CS in section.

Figure 13:
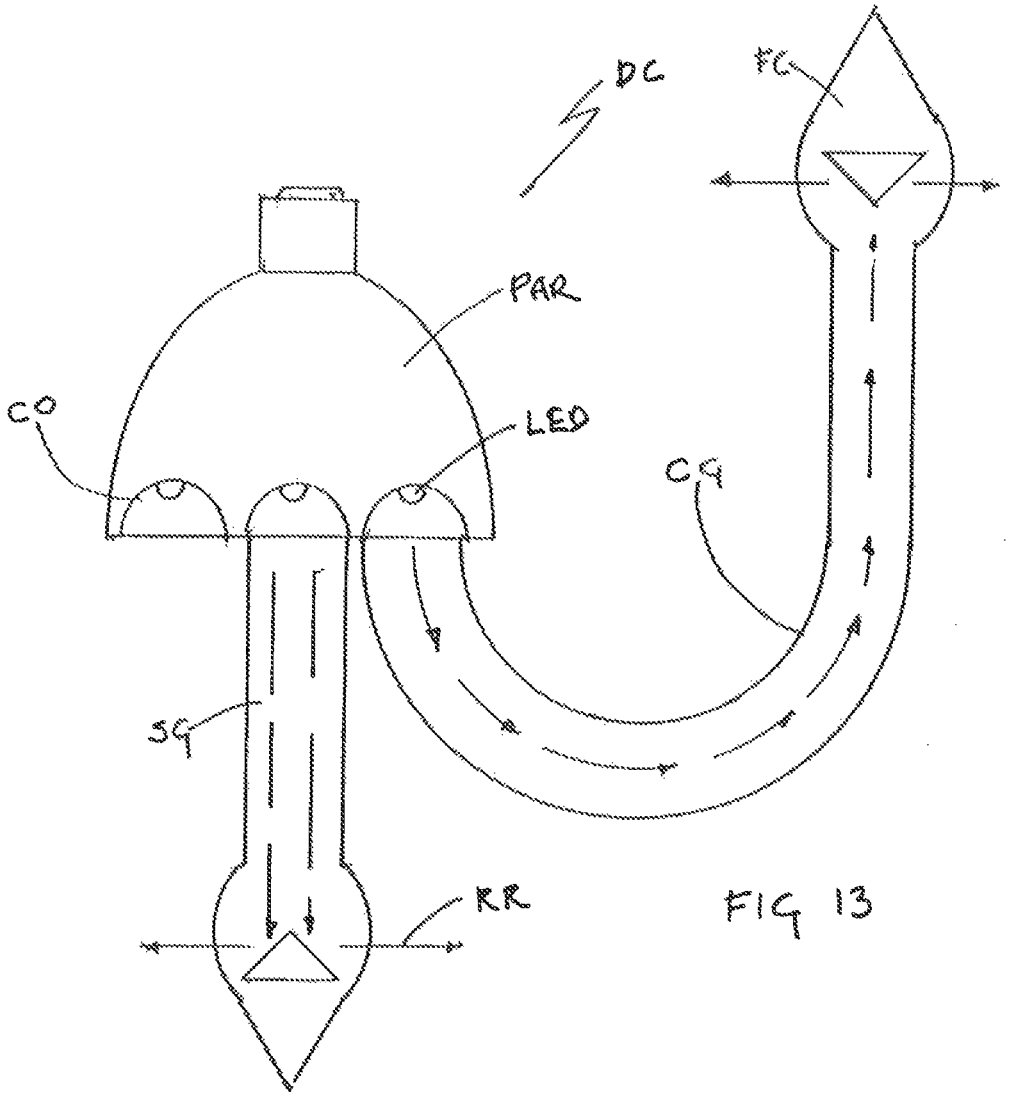
FIG. 13 is a side view diagram of an LED PAR type bulb with light guide components, constructed in accordance with one embodiment of the present invention.

FIG. 13 is a side view diagram of a decorative candelabra-type luminaire DC constructed from a standard LED forward projecting light bulb PAR that contains at least two geometrically arranged LEDs LED, each at least partially surrounded by a concentrating optic CO, and has an adaptive optical structure containing straight light guides SG and or curved light guides CG that collect and guide concentrated light projected by the concentrating optics CO within the forward projecting light bulb PR into a decorative refractive optic FC that may create the illusion of a candle flame.

What is claimed is:

1. A multifunction LED light bulb comprising:

a) A first optical structure surrounding a central optical axis and containing at least one LED at least partially surrounded by a concentrating surface, the first optical structure performing a first lighting function of projecting a forward concentrated beam surrounding and in the direction of a central optical axis of the bulb;

b) A second optical structure containing at least one LED at least partially surrounded by a concentrating surface and a radially reflecting surface, the second lighting structure performing a second lighting function by projecting a concentrated radial beam away from the optical axis;

wherein the LEDs and optical surfaces of the first optical structure performing the first lighting function, and the LEDs and optical surfaces of the second optical structure performing the second lighting function are so disposed as to not obstruct the projected light emanating from the LEDs or their associated optics.

2. A multifunction light bulb as in claim 1 wherein the optical structures and their associated optical surfaces that perform both lighting functions are incorporated into a single unified molded element.

3. A multifunction light bulb as in claim 1 wherein the optical structure performing the second lighting function comprises internally reflecting surfaces that function as a light guide for the radially projected beam.

4. A multifunction light bulb as in claim 1 wherein the concentrating surface(s) of the first optical structure is (are) parabolic.

5. A multifunction light bulb as in claim 1 wherein the first lighting function of the first optical structure and the radially reflecting surface of the second optical structure are performed by a single optic having an internal surface with a first portion shaped and located to receive light from the first LED at a high angle of incidence and refract substantial all light along the optical axis through the internal surface, and a second portion of the internal surface being shaped and located to receive light from the second LED at a low angle of incidence to reflect that light radially.

6. A multifunction light bulb as in claim 5 wherein the unified single surface is parabolic.

7. A multifunction light bulb as in claim 5 wherein the unified single surface is elipsoidal.

8. A multifunction light bulb as in claim 1 wherein the first optical structure comprises a single LED located on the central axis and is at least partially surrounded by a concentrating surface, and wherein the second optical structure comprises at least two LEDs that extend outward from and are disposed around the optical axis, each at least partially surrounded by a concentrating optic, and a reflective ring that reflects light from the LED and its associated concentrating optic as a radial beam away from the central axis.

9. A composite multifunction light bulb system comprising:

a) A first component being a reflector type light bulb having a central optical axis, and a optical structure containing at least one LED at least partially surrounded by a concentrating reflector projecting a concentrated linear beam surrounding and in the direction of the central optical axis;

b) a second component being an adaptor containing an optical structure and a mechanism for attachment to the first component;

c) the optical structure of the second component having an optical element(s) that redirect at least a portion of the concentrated linear beam projected by the optical structure of the first component in a direction away from the central optical axis.

10. A composite multifunction light bulb system as in claim 9 wherein the optical structure of the second component contains a reflective surface that redirects and projects at least a portion of the linear concentrated beam projected by the optical structure of the first component as a beam radiating outward from the optical axis.

11. A composite multifunction light bulb system as in claim 9 wherein the optical structure of the second component contains at least one rod shaped light guide that receives light from an entry end of the light guide and guides at least a portion of the linear concentrated beams projected by the optical structure of the first component away from the first component.

12. An optical structure for radially projecting a beam comprising:

a substantially disk shaped optical element at least partially surrounding one LED and sharing the optical axis with one LED that is located on the optical axis at the entry surface of a disk shaped optical element, the disk shaped optical element having a radially disposed internally reflecting toroidal concentrating optic, and an exit surface circumscribing the disk through which radially reflected light (emanating from the LED) can pass, and at least one step in the surface of the disk that surrounds the optical axis, the face of the step forming an exit surface through which radially reflected light can pass, and wherein the step(s) in the surface remove(s) and reduce(s) mass from the disk shaped optical element.

13. An optical configuration as in claim 12 wherein the face of at least one of the step(s) is (are) substantially at an angle to a surface of the disk to which it is connected.

14. A composite multifunction light bulb system as in claim 10 wherein the optical structure of the first component contains an array of LEDs at least one of which is at least partially surrounded by a concentrating optic, the optical structure of the second component containing an internally reflecting cone that is axially aligned the concentrating reflector(s) of the first component system.

15. A composite multifunction light bulb system as in claim 11 wherein the light guide(s) further contains a refracting element disposed at the exit end of the light guide.

16. A composite multifunction light bulb system as in claim 15 wherein the refracting element refracts light simulating that of a candle fame.

17. An LED multi function Lighting assembly for use in light bulbs and luminaires comprising:

At least two rings of LEDs surrounding a common optical axis, each ring containing at least two LEDs mounted to a ring shaped substrate, the LEDS of one of the ring are so disposed as to radiate light outward and away from the optical axis, the LEDs of the other of the at least two rings of LEDs are so disposed as to radiate light inward and towards the optical axis.

18. An LED multi function lighting assembly as in claim 17 wherein at least two of the at least two rings of LEDs are disposed on the same plane as an inner and outer ring, the LEDs on the inner ring facing inwardly toward the optical axis, the LEDs of the outer ring facing outwardly away from the optical axis.

19. An LED multi function lighting assembly as in claim 17 wherein the ring of LEDs containing the outwardly disposed LEDs is surrounded by a focusing ring.

20. An LED Multifunction Lighting assembly as in claim 17 wherein the LEDS of at least one of the rings of LEDs radiate light onto a reflective ring that is further contained within the lighting assembly.

* * * * *